United States Patent [19]

Falkner

[11] 4,088,306

[45] May 9, 1978

[54] ROPE OR CABLE WINCH

[76] Inventor: Raimund Falkner, Roppen Nr. 64, Austria A-6426

[21] Appl. No.: 679,699

[22] Filed: Apr. 23, 1976

[30] Foreign Application Priority Data

Apr. 28, 1975 Austria ..... 3270/75

[51] Int. Cl.[2] ..... B66D 1/00

[52] U.S. Cl. ..... 254/187.8; 74/804

[58] Field of Search ..... 254/187 R, 187 C, 186 R, 254/186 AC, 170; 74/804, 805

[56] References Cited

U.S. PATENT DOCUMENTS

| | | | |
|---|---|---|---|
| 1,445,151 | 2/1923 | Mercer | 254/187 C |
| 2,418,267 | 4/1947 | Lawler | 254/187 C |
| 2,710,738 | 6/1955 | Wittberger | 254/186 R |
| 3,129,611 | 4/1964 | Lee | 74/804 |
| 3,160,032 | 12/1964 | Black | 74/804 |
| 3,307,434 | 3/1967 | Kope | 74/804 |
| 3,320,828 | 5/1967 | Grant | 74/804 |
| 3,627,087 | 12/1971 | Eskridge | 254/186 R |

*Primary Examiner*—Trygve M. Blix

*Assistant Examiner*—Kenneth Noland

*Attorney, Agent, or Firm*—McGlew and Tuttle

[57] ABSTRACT

A winch for coiling rope or wire having a rope or wire-supporting drum mounted for free rotation, an off-drive shaft mounted axially to the drum, a clutch for engaging the drum to the shaft, a driving motor, a driving shaft rotatable by the motor and a gear reduction between the drive shaft and the off-drive shaft comprising, a drive sprocket eccentrically mounted on the drive shaft and freely rotatable thereon, a holding arm which keeps the drive sprocket from rotating as the drive shaft rotates, an off-drive sprocket connected to the off-drive shaft and axially aligned with the drive shaft, and rotation transmission chains on the off-drive sprocket which are engageable with at least a part of the drive sprocket. The drive sprocket undulates about the axis of rotation of the drive shaft and by its positive engagement with the inner surface of the transmission chain, transfers rotary energy to the off-drive sprocket, the relationship between drive shaft rotation and off-drive shaft rotation being a function of the difference between the sprocket radii.

10 Claims, 5 Drawing Figures

ROPE OR CABLE WINCH

BACKGROUND OF THE INVENTION

1. Field of the Invention

This invention relates in general to rope or cable winches and in particular to a new and useful winch design having an effective simple and lightweight gear reduction, clutch assembly and braking device.

2. Description of the Prior Art

Rope or cable winches have been known which are operated by a motor and generally consist of a support, of a rope or cable drum positioned on said support, of a reduction gear comprising either a worm drive or several jackshafts, an intermediate clutch and a braking device.

The complexity and size of the prior art winches made small lightweight winches adapted for portability, difficult to manufacture.

Besides these rope and cable winches having integral driving motors, annex cable winches have also been known for attachment to the motor of a chain saw. It is evident that these attachment devices also have all the elements mentioned above, so that the weight and volume of the supplementary winch apparatus exceeds of that the chain saw motor. These devices in particular should be easy to handle and to transport, as their main application, namely working and removal of tree trunks, requires a considerable mobility on the part of the operating personnel and devices.

SUMMARY OF THE INVENTION

The present invention provides a winch with a gear reducing feature and clutch feature which can be used conjointly to power the winch or to be used as a brake. A drive shaft, drive sprocket, take-off drive sprocket and shaft and clutch assembly are advantageously adapted to be housed within the rope or cable supporting drum and enlarged flange thereof, in order to form a highly compact and light weight device that may easily be carried from location to location as needed. This device however still provides a high gear reduction ratio and positive transmission of power from the motor to the winch drum.

In one embodiment of the invention the reduction gear is formed by a drive sprocket and a larger off-drive sprocket adjacent each other and having parallel axes of rotation. The off-drive sprocket is fixed to an off-drive shaft which is axially aligned with the rope or cable supporting drum and is engageable with the off-drive shaft for rotation by means of a disc clutch arrangement. Discs of the clutch are arranged on the outer surface of the off-drive shaft. Through the use of a hand wheel at the end of the winch assembly, these two sets of discs can be moved together and thereby cause the rotation of the powered off-drive shaft to be transferred to the drum.

The smaller drive sprocket is mounted on an eccentric hub of the shaft. The mounting between the drive shaft hub and drive sprocket consists of a bearing so that there is free rotation between the two elements. The drive sprocket is further held from rotating by an arm extending radially therefrom the sprocket and slidably mounted on a stationary part of the winch housing. When the drive shaft is rotated by a motor the drive sp sprocket moves in an eccentric path about the axis of rotation. The off-drive sprocket is rotatably mounted near the drive sprocket, concentric with the axis of rotation of the drive shaft and with its circumference aligned with the path of the outer circumference of the drive shaft at its maximum eccentric radius. A transfer means or double roller chain is provided on the circumference of the larger off-drive sprocket so that one chain is on the off-drive sprocket and the other is in the maximum eccentric path of the drive sprocket circumference. In this position the drive sprocket engages the second chain at one portion of its circumference and due to its reduced diameter and number of cogs, cause the other sprocket to rotate. The ratio thus obtained will be equal to the diameter or number of cogs in the larger off-drive sprocket to the difference between that diameter or number and that of the smaller drive sprocket. For example, an off-drive sprocket having 50 cogs driven by a drive sprocket having 49 cogs will yield a ratio of 50:1 or 50 to (50-49).

Another embodiment of the invention provides a multiple chain is a double roller chain. The friction, arising from the meshing and disengagement of the chain cogs is thus greatly reduced.

It does not matter which of the two sprockets has the bigger diameter in construction of the winch. It is advantageous, however, for the sprocket, which is fixed to the off-drive shaft to have the bigger diameter, so that the eccentric movement of the second sprocket takes place within the circumferential line of the concentric sprocket.

According to the invention, the drive sprocket can be held from rotation by means of a second parallel shaft with a second eccentric hub, rotating in the same direction as the first. Preferably, the two shafts are linked. This embodiment is particulary advantageous when no axial arm extending outwardly can be arranged in the winch housing. A further embodiment of the invention provides two sprockets positioned on the driving shaft eccentrically irrotationally and dephasedly, the diameter of which sprockets being smaller than the diameter of the sprocket of the driving shaft, said sprockets being connected with each other safe against torsion. This embodiment shows another eccentric sprocket, but, by the direct connection to each other which is safe against torsion of the two eccentric and dephased sprockets, no axial arm extending outwardly from the inside of the gear is necessary. The connection between the concentric sprocket of the off-drive shaft and one eccentric sprocket of the driving shaft may of course again take place via a double roller chain, a triple roller chain, however, may preferably used with this embodiment.

Accordingly it is an object of the present invention to provide a portable rope or cable winch having a high gear reduction ratio, small compact size and a clutch means that can also be used as a brake, to slow the rotation of the winch drum.

A further object of the invention is to provide a winch which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

Figure 1:
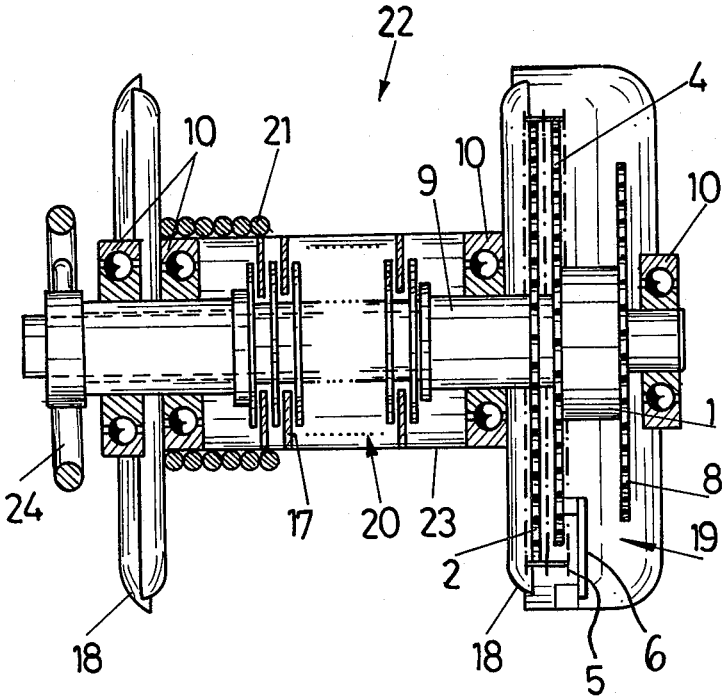
FIG. 1 is an axial section through a rope or cable winch according to the invention.

Referring to the drawings in particular, the invention embodied therein in FIG. 1, comprises a cable winch having a rope or cable drum generally designated 22, with a drum cylinder 23 and side flanges 18, 18' at each side thereof. On the drum cylinder 23, coils 21 are wound. In the area within the rope or cable winch 22, a clutch 20, having the form of a disk clutch 17, and a reduction gear generally designated 19, are arranged. The disk clutch 17 can be actuated by means of a handwheel 24, axially extending from the drum cylinder. When the driving motor stops or when the reduction gear is locked by means of a locking device, not shown, the disk clutch 17 may serve a braking device by turning the handwheel 24 in order to brake the rope or cable drum 22. The reduction gear 19 is arranged within the somewhat enlarged side flange 18. The driving shaft 9 carries the disk clutch 17.

Figure 2:
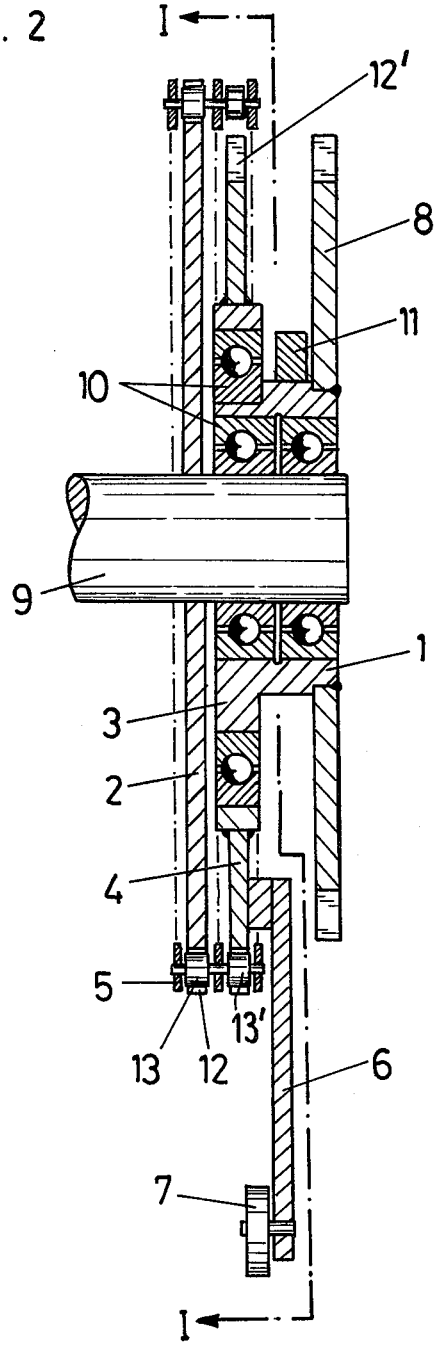
FIG. 2 is an axial section on an enlarged scale through the reduction gear on the line II—II in FIG. 3.
Figure 3:
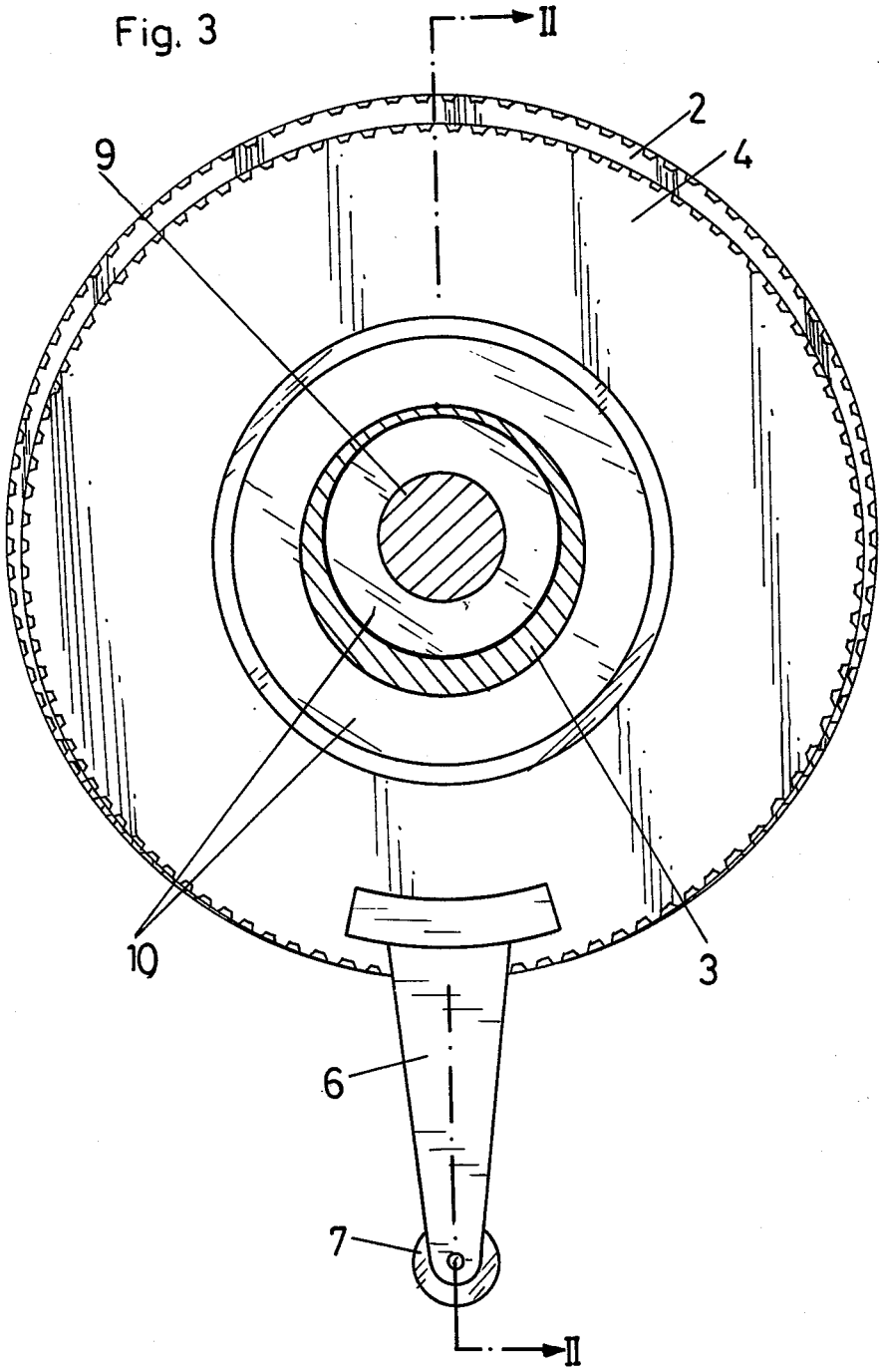
FIG. 3 is a front view of the reduction gear on the line III—III in FIG. 2.

As shown in FIGS. 1 - 3 the reduction gear 19 is provided with a driving or first shaft 1, which is coaxial with the off-drive or second shaft 9. First shaft 1 is driven by a motor or hand crank (not shown) engaged with sprocket 8. Eccentric hub 3 is fixed to shaft 1 and has a first sprocket 4 rotatably mounted on its periphery. Sprocket 4 is held from rotation by holding means comprising arm 6 and roller 7 which is slidably mounted in a fixed portion of the winch housing. A second sprocket 2 is concentrically positioned and fixed is the off-drive shaft 9, cogs 12 on sprocket 2 and 12' on sprocket 4 are embraced by a rim or gear means 13 which may be a multiple roller chain 5 having the form of a double roller chain. At a small distance from sprocket 2, defined by the double roller chain, the first sprocket 4 having a smaller diameter, is eccentrically positioned on a ball bearing 10 arranged on the driving shaft 1. The sprocket 4 gyrates on the eccenter hub 3 of the driving shaft 1, but does not rotate.

The eccentricity of hub 3 and the radius of the smaller sprocket 4 correspond to the radius of the bigger sprocket 2; so that the smaller sprocket 4 always completely meshes in the second free rim 13' of the double roller chain 5, on at least a portion of its circumference. Upon one rotation of the driving shaft 1 the off-drive shaft 9 is turned a known angle by the eccentrical gyrating sprocket 4 via the concentric sprocket 2. This angle is defined by the difference between the number of cogs of the two sprockets 2,4. As noted, of this difference is one cog when there are 50 cogs of the bigger sprocket 2, there exists a reducing gear ratio of 50 : 1.

The driving shaft 1 of the reduction gear may be directly connected to a motor (not shown) or, as indicated in FIGS. 1 and 2, carry another gear 8. If the cable or rope winch according to the invention serves as a supplementary apparatus for a chain saw motor, the gear 8 can also be a sprocket and can be connected to the pinion of the motor by means of a chain. In order to obtain quiet running of the rope or cable winch, the driving shaft 1 is conventionally balanced, e.g. by means of a compensating weight 11.

Figure 4:
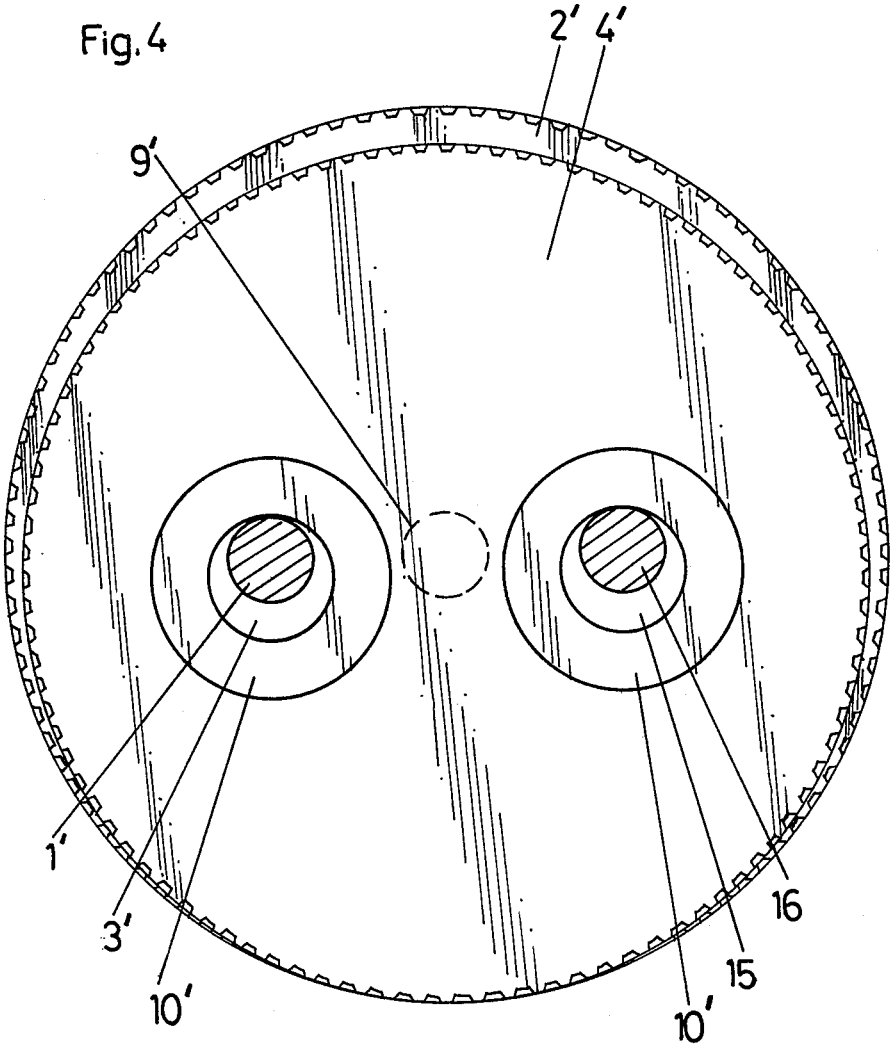
FIG. 4 is a front view of another embodiment of the reduction gear similar to FIG. 3

FIG. 4 illustrates another embodiment of the reduction gear, adapted to be mounted into a rope or cable winch. This reduction gear is provided with a sprocket 2', concentrically arranged on the off-drive shaft 9', the cogs of which sprocket are embraced by a double roller chain not shown. A parallel shaft 16 is arranged in parallel to the driving shaft 1'. This driving shaft is provided with the eccenter 3' hub and is parallel to the drive-off shaft 9'. The parallel shaft 16 has an eccenter hub 15 which is parallel to eccenter hub 3'. The driving shaft 1' and the parallel shaft 16 rotate in the same direction and are preferably linked to each other. The eccentric sprocket 4' then gyrates on both hubs 3' and 15 through bearings 10',10'. Rotation of sprocket 4' is thus avoided. This design therefor requires no radial arm extending outwardly. The linkage (not shown) of the driving shaft 1' and the parallel shaft 16 may e.g. be effective by means of a chain or via an intermediate gear.

Figure 5:
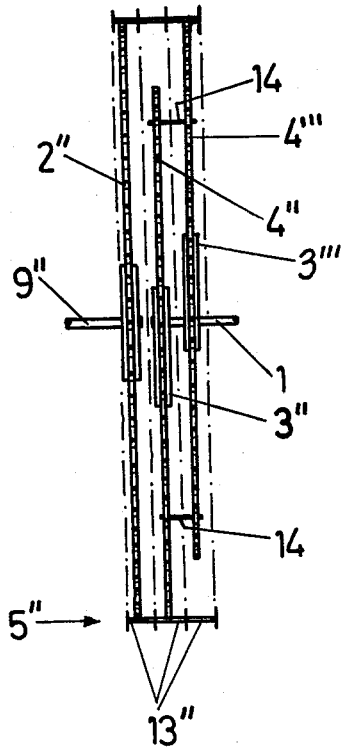
FIG. 5 is a diagrammatic view of another embodiment of the gear, similar to FIG. 2.
Figure 2:
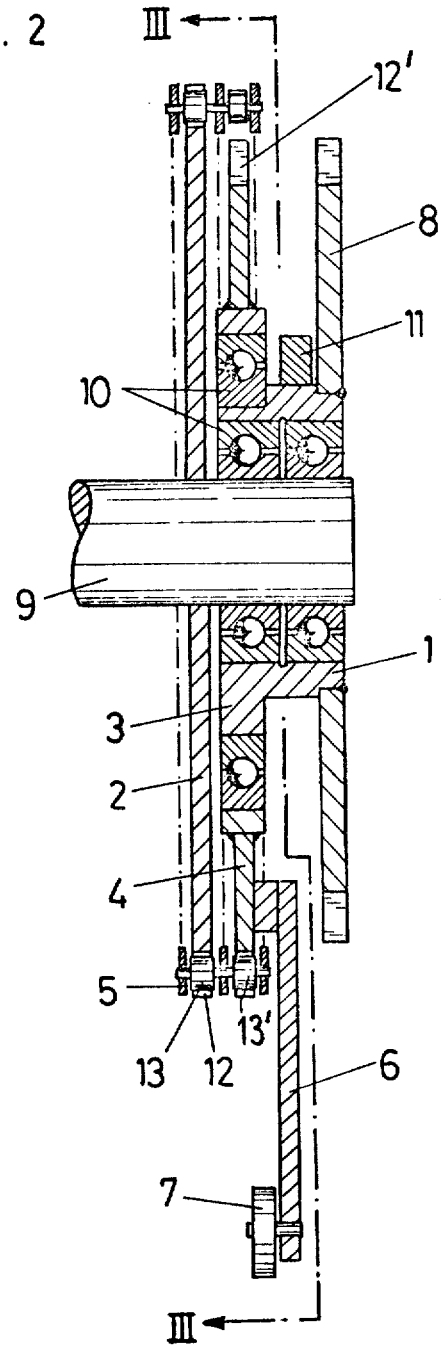

FIG. 5 is a diagrammatic view of a further embodiment of a reduction gear adapted to be mounted in the rope or cable winch. A sprocket 2' is fixed on the off-drive shaft 9'', being embraced by a rim 13'' of the multiple chain 5'' having the form of a triple roller chain in this case. The cogs of one sprocket 4' each mesh with one of the two other rims 13' of the triple chain. The eccenters of both the sprockets 4', 4'' on hubs are staggered, preferably at 180°, and both the sprockets show at least one connection 14 being mutually safe against torsion thus to preventing each from rotating. This embodiment as well does not require an outwardly extending axial arm. Instead of the triple roller chain a double roller chain may be used with this embodiment as well, as for transmission of the rotary motion the mesh only of the sprocket 4'' into the chain 5'' is necessary. In this very case the second sprochet 4''' may be a conventional disk without cogs.

Furthermore it is possible in the embodiment according to FIG. 1 - 3, that the eccentric sprocket 4 has a bigger diameter than the concentric sprocket 2 and that the double roller chain embraces this sprocket.

The rope or cable winch according to the invention has low weight due to its restricted dimensions and to its simple and cheap construction, so that it is easy to handle. The few constituent parts are arranged in the inside of the drum protected against damages and pollution, ensuring reduced susceptibility to breakdowns and long durability.

While specific embodiments of the invention have been shown and described in detail to illustrate the application of the principles of the invention, it will be understood that the invention may be embodied otherwise without departing from such principles.

What I claim is:

1. A winch having a rotatable cable drum comprising a rotatable first shaft having an eccentric hub portion, a first sprocket rotatably mounted on said eccentric hub for eccentric gyrating movement on said hub portion when said first shaft is rotated, holding means connected to said first sprocket at a fixed point for preventing rotation thereof whereby said holding means is allowed to oscillate when said first sprocket gyrates, a second sprocket rotatably mounted adjacent said first sprocket and having second annular gear means, said first sprocket having first annular gear means of a diameter different than said second annular gear means and being engageably with at least a portion of said second annular gear means for effecting rotation of said second annular gear means by the eccentric gyrating movement of said first sprocket at a rotational rate less than the rotation of said first shaft, a second shaft connected to said second sprocket for rotation therewith, clutch means connected between said drum and said second shaft being situated in said drum, and means for engaging said clutch means with said drum for rotating said drum with the rotation of said second shaft, said drum including an enlarged side flange and said sprockets being disposed in said flange.

2. A winch according to claim 1, wherein said holding means further comprises, a holding arm connected to said first sprocket and extending radially therefrom, and mounting means slidably connecting said holding arm to a fixed portion of said winch.

3. A winch according to claim 1, wherein said annular gear means further comprises an annular double chain having one chain portion on said second sprocket and a second chain portion on at least a part of said first sprocket.

4. A winch according to claim 1, wherein said annular gear means comprises a double roller chain.

5. A winch according to claim 1, wherein said holding means further comprises a second eccentric hub on said first shaft spaced from said first-mentioned eccentric hub, a disc rotatable on said second hub, means connecting said first sprocket and said disc to prevent relative rotation therebetween.

6. A winch according to claim 5, wherein said disc is a third sprocket and said annular gear means is engageable with at least a portion of said third sprocket.

7. A winch according to claim 1, wherein said clutch means further comprises at least one annular disc on said second shaft, at least one inwardly extending annular disc on said drum and means for moving said shaft disc against said drum disc for transmission of rotary energy from said second shaft to said drum.

8. A winch according to claim 7, wherein said means for moving said shaft is a hand wheel and screw on said shaft.

9. A winch according to claim 1, wherein said first sprocket has a larger diameter than said second sprocket.

10. A winch according to claim 1, wherein said holding means further comprises a third shaft parallel and rotatable in synchronism with said first shaft and having a second eccentric hub portion, said third shaft being spaced from said first shaft and said former mentioned eccentric hub portion and said second eccentric hub portion being rotatably mounted on said first sprocket to effect said eccentric movement of said first sprocket.

* * * * *

UNITED STATES PATENT OFFICE

CERTIFICATE OF CORRECTION

Patent No. 4,088,306 Dated May 9, 1978

Inventor(s) Raimund Falkner

It is certified that error appears in the above-identified patent and that said Letters Patent are hereby corrected as shown below:

Figure 2 should appear as shown on the attached sheet.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*